US006233775B1

(12) United States Patent
Franke

(10) Patent No.: US 6,233,775 B1
(45) Date of Patent: May 22, 2001

(54) FLOOR MOPPING DEVICE

(75) Inventor: Hans-Georg Franke, Hirschberg (DE)

(73) Assignee: Carl Freudenberg, Weinheim (DE)

( * ) Notice: Subject to any disclaimer, the term of this patent is extended or adjusted under 35 U.S.C. 154(b) by 0 days.

(21) Appl. No.: 09/367,177

(22) PCT Filed: Dec. 8, 1997

(86) PCT No.: PCT/EP97/06835

§ 371 Date: Oct. 22, 1999

§ 102(e) Date: Oct. 22, 1999

(87) PCT Pub. No.: WO99/29225

PCT Pub. Date: Jun. 17, 1999

(51) Int. Cl.[7] ..... A47L 13/142
(52) U.S. Cl. ..... 15/120.2; 15/120.1
(58) Field of Search ..... 15/116.1, 119.1, 15/120.1, 120.2

(56) References Cited

U.S. PATENT DOCUMENTS

| | | | | |
|---|---|---|---|---|
| 248,044 | * | 10/1881 | Kidney | 15/120.2 |
| 1,550,369 | * | 8/1925 | Knol | 15/120.2 |
| 1,567,519 | | 12/1925 | Leclerc et al. | 15/120.2 |
| 1,724,308 | | 8/1929 | Phipps | 15/120.2 |
| 5,509,163 | * | 4/1996 | Morad | 15/120.2 |
| 5,850,658 | * | 12/1998 | Specht | 15/120.1 |

FOREIGN PATENT DOCUMENTS

| | | |
|---|---|---|
| 104093 | 2/1917 | (GB) . |
| 97-24973 | 7/1997 | (WO) . |

* cited by examiner

*Primary Examiner*—Mark Spisich
(74) *Attorney, Agent, or Firm*—Fulbright & Jaworski, LLP

(57) ABSTRACT

A floor mopping device has a columnar shaft with a front end; a barrel surrounding the shaft and rotatable about the shaft; a disengageable clutch system connecting the shaft with the barrel in the wringing mode which restricts the relative rotatability of the shaft and barrel to one sense of rotation and in which an abutment of barrel, extending transversely with respect to the longitudinal axis of the shaft, is in engagement with a deflectable counter-abutment of the shaft. A number of flexible absorbent strips join together the end of the shaft and the barrel. The clutch system cooperates with a disengageable member affixed to the shaft which underreach the barrel in the area of an annular surface of the barrel facing the end of the shaft. The abutment on the barrel has a base which runs transversely with respect to the longitudinal axis. The counter-abutment of the shaft is associated with the abutment of the barrel with a form corresponding to its shape, the counter-abutment forming a component of a ring surrounding the shaft. The ring is mounted for axial displacement on the shaft and capable of being be pressed against the barrel when in the wringing mode by a spring disposed adjacent the ring.

9 Claims, 4 Drawing Sheets

FLOOR MOPPING DEVICE

TECHNICAL FIELD

The invention relates to a floor mopping device comprising a columnar shaft with a front end, a barrel surrounding the shaft and able to be shifted and rotated relative to its axis, a disengageable clutch which connects the shaft to the barrel and restricts the relative rotation of the two parts to a given sense of rotation and in which at least one abutment extending parallel to the shaft on the one part is in engagement with a resiliently deflectable counter-abutment on the other part, and a number of flexible, absorbent strips connect together the end of the shaft and the barrel.

STATE OF THE ART

Such a floor mopping device is disclosed in U.S. Pat. No. 5,509,162, wherein the abutments preventing the relative rotations of the barrel on the shaft are associated with the shaft. They are formed of a plurality of ribs distributed uniformly over the circumference which run parallel to the axis of the shaft. Forming them on the shaft involves great tooling cost. It is indeed possible to limit the number of ribs to two, making them easier to fabricate. Normally, however, it is only after a more or less great reverse rotation of the barrel that they come into engagement with the counter-abutment formed by a pawl, which prevents the strips from being wrung after they have previously been wetted with water.

In the known device the pawl is disposed in the barrel. For reasons of space it is of very small dimensions and accordingly very delicate from the mechanical point of view.

GENERAL DESCRIPTION OF THE INVENTION

The invention is addressed to the problem of further developing a floor mopping device of the kind described in the beginning such that greater sturdiness combined with simplified manufacture will result, along with the possibility of wringing the strips better after they have become wet.

This problem is solved according to the invention by a floor mopping device of the kind described above in which the clutch cooperates with disengageable means affixed to the shaft, which latch upon the barrel at an annular surface facing the end, the abutment being provided on the barrel and having a base extending transversely across the shaft. The abutment thus normally forms an axially parallel projection which is disposed on an imaginary annular surface surrounding the shaft. To manufacture a molding bearing the abutment by the injection molding process it is therefore possible to use molds having only two halves if the base of the abutment is arranged in the plane of separation. The abutment projecting parallel to the opening direction when such a mold is used can be made as large almost as desired by using a corresponding method of manufacture and can be subdivided into almost any desired number of partial abutments following one another in the circumferential direction and/or in the radial direction, which makes it possible during the intended use of the counter-abutment to reduce the reaction forces applied to it to such an extent that, almost regardless of the magnitude of those forces, the clutch can be used without wear. This is a great advantage with regard to the useful life of the floor mopping device.

The flexible, absorbent strips can consist of any material known for the purpose, such as fiber strands, or a textile and/or foam material. They are generally distributed substantially uniformly circumferentially and are extended in loops by shifting the barrel toward the end of the shaft, wetted with water, and used to perform cleaning procedures. After the dirt has been picked up the strips are rinsed in water and put into a more or less stretched position by a relative displacement of the barrel on the shaft. When this position is reached the barrel comes into engagement with the disengageable means affixed on the shaft, which catch it at an annular surface facing the end and prevent the barrel from being easily moved back toward the end. It is thus made possible for the user to produce a tension in the strips by a relative rotation of the barrel on the shaft and thus to wring out the strips in this manner. The application of axially directed holding forces is not necessary. For the practical use of the floor mopping device this is a great advantage.

It has proven to be useful when the [disengageable] means is a component of a bell fastened on the shaft with its mouth facing the end and at the same time radially covering the outside of the clutch system. This prevents injury and improves appearance.

The disengageable means can be made to be normally engaged by the use of a leaf spring or coil spring, for example, which cooperates with the means. The means are best made easy to disengage with an actuating key.

The annular surface can define a projection of the barrel pointing radially outward toward the end of the shaft. In general, the projection is of annular configuration and disposed at the end of the barrel. The amount of material needed for the manufacture of the barrel can thus be appreciably reduced without the need to accept disadvantages as regards sturdiness or the user's grip on the barrel.

The abutment can be defined by an abutment surface which forms a component of an imaginary plane erected on the axis of the shaft in the direction of action, i.e., in the direction in which it is in contact with the counter-abutment during the intended use of the device. The forces exercised on the abutment by the counter-abutment upon a relative rotation of the barrel are, in such a configuration, applied vertically, which prevents any sticking together of the two surfaces and assures that the surfaces can be easily separated from one another after a wringing process.

The abutment is usefully defined in the direction opposite the direction of action by a helical or inclined surface surrounding the axis. The lower the angle of inclination enclosing the helical or inclined surface is, the more easily can the barrel be rotated relative to the shaft. At the same time it must be remembered that a decreasing angle of inclination necessarily results in a reduction of the size of the abutment surface. For this reason the use of angles of inclination between 5 and 35° is preferred.

In order to permit the strips to be wrung out in especially small steps to save effort it has proven to be advantageous if the abutment comprises a plurality of partial abutments uniformly distributed circumferentially. These can successively engage one or more counter-abutments.

It has proven to be useful if at least one counter-abutment on the shaft is associated with the abutment on the barrel and is of a shape and size corresponding to its form. It is also possible to make the abutment and the counter-abutment or the partial abutments and the counter-partial abutments mate with one another.

The counter-abutment can be a component of a ring surrounding the shaft. It is good for it to be axially displaceable along the shaft and able to be pressed against the barrel, for example by a spring which is formed by a resilient foam material ring surrounding the shaft.

DETAILED DESCRIPTION OF THE INVENTION

Figure 1:
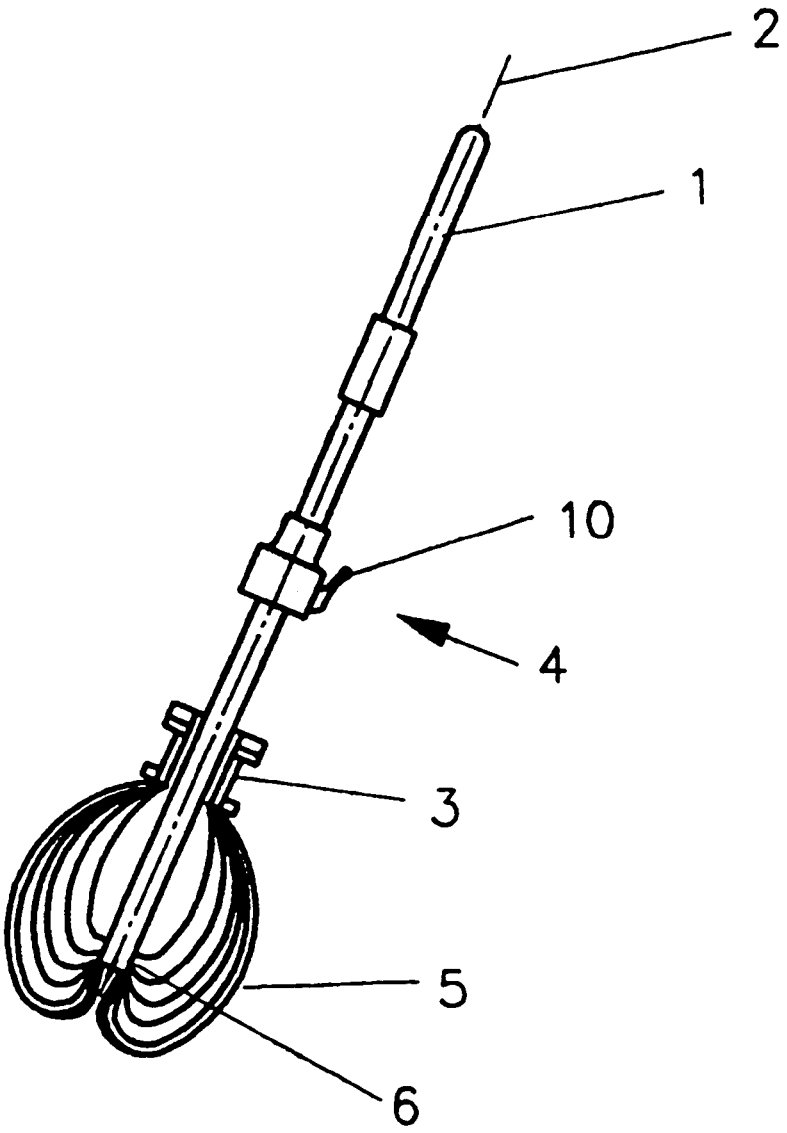
FIG. 1 shows a floor mopping device in a schematic manner.

In FIG. 1 an example of the floor mopping device is represented schematically. The floor mopping device comprises a column-like shaft 1 at whose bottom end 6 a number of flexible, absorbent strips 5 is non-rotatably fastened. The strips are distributed circumferentially in a substantially uniform manner. They can consist of fiber strings, but if necessary also of a similarly flexible and absorbent textile or foam material. The end opposite end 6 of shaft 1 is non-rotatably fastened to a barrel 3. This barrel is displaceable toward a clutch system 4 and is relatively rotatable with the latter, but can be brought into engagement axially undisplaceably with the latter in order to produce a stretching of the strips 5 and by a relative rotation of the barrel 3 to produce a tension in the strips 5 for the purpose of wringing them out. An actuating key 10 is associated with the clutch 4, which permits the strips after a wringing process thus performed to lay themselves out in loops and enable them to be used for a floor mopping process.

Figure 2:
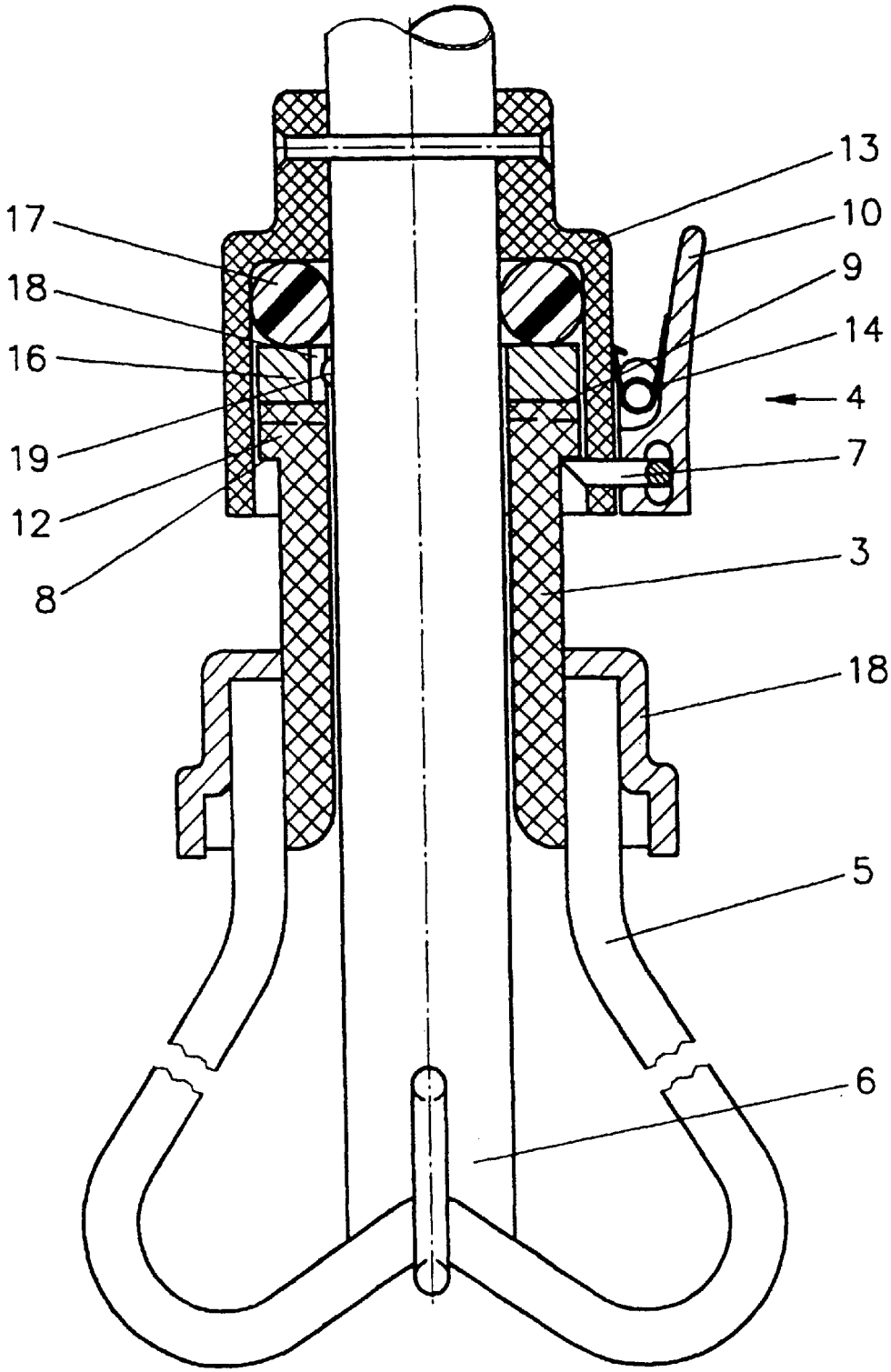
FIG. 2 a longitudinal section through a number of parts important to the operation of the floor mopping device, FIG. 3 a cross section of a part of the clutch system, and FIG. 4 a side view of a part of the clutch system.
Figure 3:
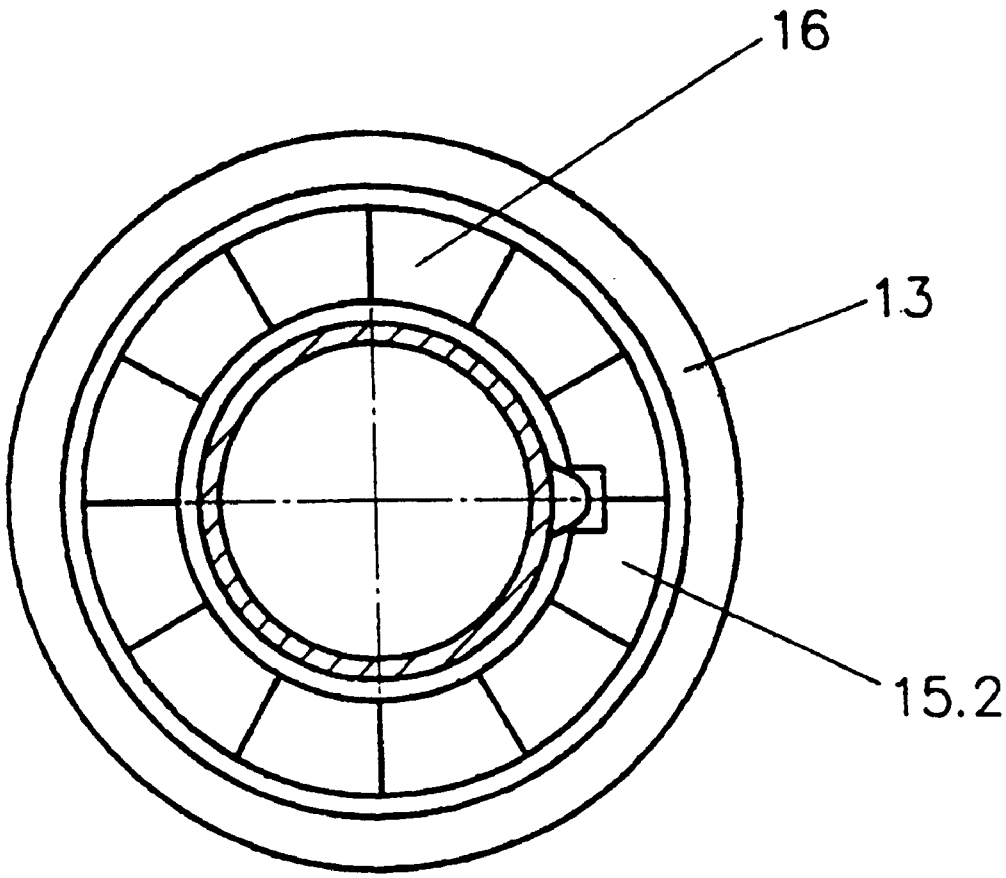

Additional details of the floor mopping device and especially of the clutch system 4 contained therein are presented in the longitudinal section in FIG. 2.

The floor mopping device accordingly comprises a column-like shaft 1 which in the embodiment shown consists of a plastic-jacketed metal tube.

At the bottom end 6 of the shaft 1 a great number of flexible, absorbent strips 5 are non-rotatably fastened which consist of fiber strands. To fasten them a clip is provided which fits around the middle of the strips 5 and is snapped into a radial bore in the shaft 1. The ends of the strips 5 remote from the end 6 of the shaft 1 are gripped non-rotatably in a plastic barrel 3. The bottom end of the plastic barrel 3 is for this purpose configured like a gear, the strips 5 being inserted into the gaps between the individual teeth and pressed against the outer circumference of the barrel 5 using a plastic collar 18.

At the upper end of the barrel 3 there is provided a rim 12 of annular configuration and reaching radially outward, which is defined at the bottom by an annular surface 8 and at the top by projections 9 (FIG. 4) uniformly distributed about its circumference. The projections 9 are arranged on a base extending transversely across the axis 2 and are formed to that extent by axially parallel projections.

In the position indicated in FIG. 2 the abutments 9 are in engagement with counter-abutments 15 which form a component of a ring 16 surrounding the shaft 1 and are of a size and shape to match them. The ring 16 is axially displaceable on the shaft 1 and urged elastically by a spring 17 against the barrel 3. The spring 17 is formed by a foam material ring which is configured like an O-ring and concentrically surrounds the shaft 1. To prevent relative rotation, the inside of the ring 16 contains an axially parallel groove 18 which straddles a radial projection 19 of the shaft 1. The abutments 9, the counter-abutments 15, the ring 16 and the spring 17 are surrounded by a plastic bell 13 which is affixed to the shaft 1, being fastened in the present case by a rivet.

By means of the bell 13 undisplaceably held on the shaft, the disengaging means 7 are at the same time fixedly associated with the shaft 1 and reach beneath the annular surface 8 of the barrel 3 facing the end 6 of the shaft 1 and are formed by a pin that can be moved radially outward.

The pin is defined at the bottom end by a sloping surface, and the barrel at the upper end by a conical surface compatible therewith. Therefore, when the barrel 3 is introduced into the bell 13 there is therefore no need to operate the key 10. Instead, the sloping surfaces in contact with one another automatically cause a relative displacement of the pin 7 directed radially outward, until the projection 12 has passed the pin and the pin 7 has snapped against its bottom.

The position in which the bell 13 is arranged on the shaft 1 is chosen so that, upon reaching the position of the barrel 3 in this regard, the result is an extensive stretching of the strips 5.

Figure 4:
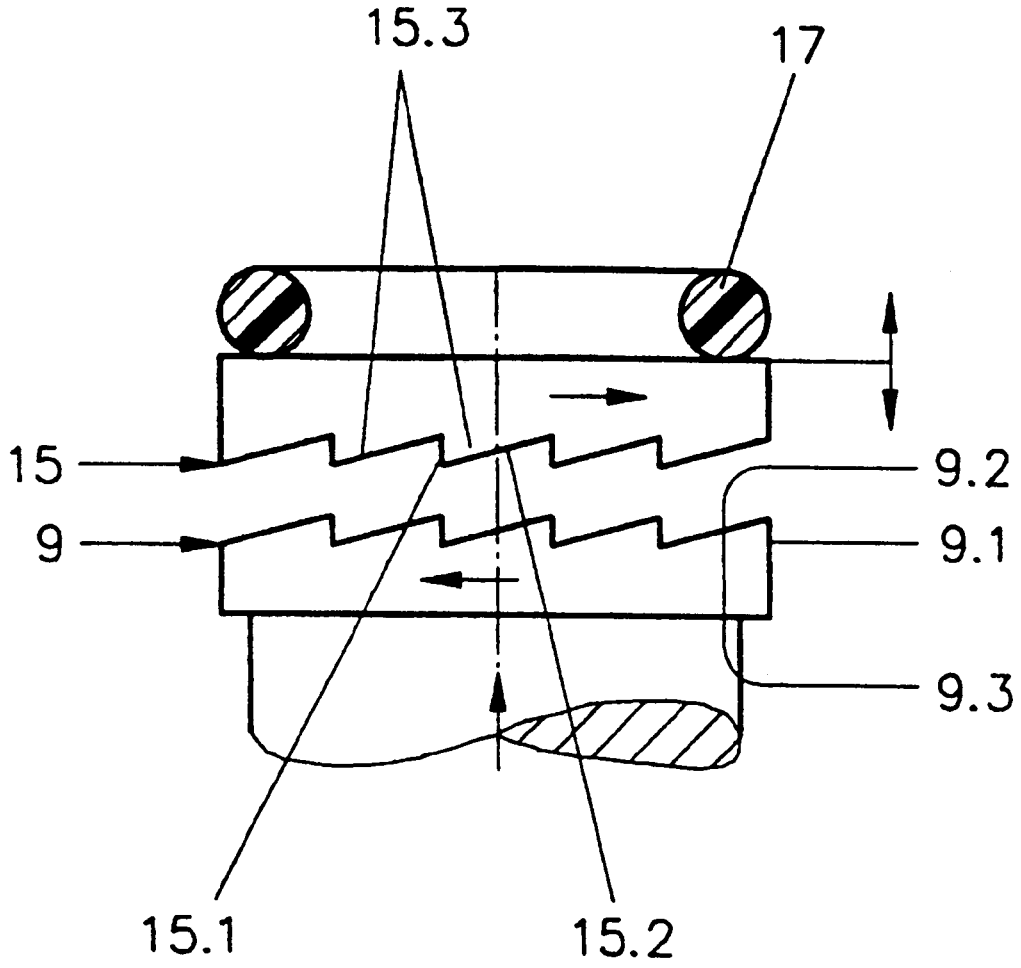

After that, a relative rotation of the barrel 3 with respect to the bell 13 is performed in the sense of the arrows inserted into FIG. 4. At the same time it results in a periodical up-and-down movement of the ring 16, while the abutments 9 pass over the tips of the counter-abutments 15. It is evident that, as the pitch angle of the abutments and counter-abutments decreases, the force which is needed for a deformation of the spring 17 decreases, but that an increasing reduction of the pitch angle simultaneously causes a lessening of the size of the abutment surfaces 9.1 and 15.1, respectively. Pitch angles between 15° and 25° are preferred for this reason.

Therefore, by a relative rotation of the barrel 3 with respect to shaft 1 a stretching and a wringing of water out of the strips 5 can be produced without the need for exerting axially directed holding forces on the barrel 3. When a sufficiently dry state of the strips 5 has been reached, the barrel therefore can be released by the clutch 4 with the result that the barrel slides downwardly on the shaft 1 toward the end 6 and the strips are changed to a shape suitable for a mopping process.

What is claimed is:

1. A floor mopping device comprising:

a columnar shaft with a front end;

a barrel surrounding the shaft and rotatable about the shaft;

a disengageable clutch system connecting the shaft with the barrel in a wringing mode which restricts the relative rotatability of the shaft and barrel to one sense of rotation and in which an abutment of the barrel, extending transversely with respect to the longitudinal axis of the shaft, is in engagement with a deflectable counter-abutment of the shaft;

a number of flexible absorbent strips joining together the end of the shaft and the barrel;

the clutch system cooperating with disengageable means affixed to the shaft which underreach the barrel in the area of an annular surface of the barrel facing the end of the shaft, wherein the abutment on the barrel has a base which runs transversely with respect to the longitudinal axis, wherein the counter-abutment of the shaft is associated with the abutment of the barrel with a form corresponding to its shape, the counter-abutment forming a component of a ring surrounding the shaft, said ring being mounted for axial displacement on the shaft and capable of being be pressed against the barrel when in the wringing mode by means of a spring disposed adjacent said ring.

2. The floor mopping device of claim 1, wherein the disengageable means forms a component of a bell affixed to the shaft and open toward the end, which externally surrounds the clutch system radially.

3. The floor mopping device of claim 1, wherein the disengageable means is normally active by a spring.

4. The floor mopping device of claim 1, wherein the disengageable means is disengageable by an actuating key.

5. the floor mopping device of claims 1, wherein the annular surface defines a radially outward-point projection of the barrel in the direction of the end.

6. The floor mopping device of claim 1, wherein the abutments are defined in the direction of action by an abutment surface which forms a component of an imaginary plane established in the axis of the shaft.

7. The floor mopping device of claim 1, wherein the abutments are defined against the direction of action by a helical or slanting surface surrounding the axis.

8. The floor mopping device of claim 1, wherein each abutment comprises several partial abutments which are uniformly distributed in a circumferential direction about the axis.

9. The floor mopping device of claim 1, wherein the spring is a foam material ring.

* * * * *